US005326017A

United States Patent [19]

Liu et al.

[11] Patent Number: 5,326,017

[45] Date of Patent: Jul. 5, 1994

[54] PAPER CONTAINER WITH MULTIPLE COMPARTMENTS PARTITIONED BY WALLS IN DIFFERENT HEIGHTS

[76] Inventors: Yuan-Shin Liu, 11th-1 Floor, No. 90, Fu Hsin S. Road, Sec. 1, Tah An District, Taipei, Taiwan; Richard C. H. Chang, 19, Alley 2, Lane 685, Chung Cheng Road, Fuan Yuan City, Taichung Hsien, Taiwan

[21] Appl. No.: 115,053

[22] Filed: Sep. 2, 1993

[51] Int. Cl.[5] ..... B65D 5/48; B65D 5/62

[52] U.S. Cl. ..... 229/120.17; 220/416; 220/462; 229/2.5 R; 229/186

[58] Field of Search ..... 229/2.5 R, 120.12, 120.17, 229/125.35, 186; 220/416, 417, 462

[56] References Cited

U.S. PATENT DOCUMENTS

| | | | |
|---|---|---|---|
| 2,591,548 | 4/1952 | Inman | 229/120.17 |
| 3,084,790 | 4/1963 | Vander Lugt, Jr. | 229/120.17 |
| 3,771,713 | 11/1973 | Davidson | 229/120.12 |
| 4,192,443 | 3/1980 | McLaren | 229/120.17 |
| 4,202,465 | 5/1980 | McLaren | 229/120.17 |
| 4,722,474 | 2/1988 | Dropsy | 220/462 |
| 4,944,451 | 7/1990 | Forbes, Jr. | 229/125.35 |
| 5,009,363 | 4/1991 | Zavatone | 229/120.17 |
| 5,056,709 | 10/1991 | Cargile, Jr. | 229/120.17 |
| 5,236,119 | 8/1993 | Chu | 229/2.5 R |

*Primary Examiner*—Gary E. Elkins
*Attorney, Agent, or Firm*—Bacon & Thomas

[57] ABSTRACT

A paper container with multiple compartments partitioned by walls in different heights, which is formed from a paper board of adequate thickness cut into a predetermined pattern. The paper board is made of paper of pure fibers and additives, laminated to adequate thickness and coated with polyethylene to meet the FDA regulations. The paper board is further formed with a middle opening and embossed with several separate folding lines to define several bottom sections located around the middle opening, partitioning wall sections adjoining the bottom sections, front, rear and lateral wall sections also adjoining the bottom sections, each two partitioning wall sections adjoin each other at one of the folding lines while the front, rear and lateral wall sections are free from connection with other wall sections of the paper board and adjoin several top edge strip sections. Three folding lines are formed at each corner contained by the wall sections, making the corner form two adjacent equiangular triangle-shaped corner connection sections, whereby each two adjacent corner connection sections and the top edge strip sections can be folded and overlapped and heat-sealed on adjacent front and lateral wall sections to form the paper container for more suitably containing various foods with different shapes and volumes.

2 Claims, 3 Drawing Sheets

PAPER CONTAINER WITH MULTIPLE COMPARTMENTS PARTITIONED BY WALLS IN DIFFERENT HEIGHTS

BACKGROUND OF THE INVENTION

The present invention relates to a paper container with multiple compartments partitioned by walls in different heights. The paper container is formed from a paper board of adequate thickness. The paper board is cut into a predetermined pattern on which a plurality of folding lines are embossed and a middle opening is formed. The folding lines define several bottom sections and partitioning wall sections which adjoin the bottom sections and have different widths, whereby the paper pattern can be folded and heat-sealed through molds to form the paper container with multiple compartments partitioned by walls in different heights for more suitably containing various foods or articles in different shapes and volumes.

Conventional food containers are mainly made of paper, polymer or plastic, wherein the polymer-made container is integrally formed from the foam material and the plastic-made container is formed from melted plastic molded in a set of upper and lower molds. Both of the polymer and plastic made food containers can be formed with several compartments to meet the requirements of containing foods. Basically, the advantages of these partitioned polymer and plastic made food containers are convenience in use and ease of to manufacture. However, such containers are not subject to natural decomposition after they are used and discarded, and therefore, will cause serious pollution of and detriment to the whole ecological environment that will cost the entire society a higher price to protect the environment. Therefore, the polymer and plastic made food containers are gradually given up by the users.

The paper container is mainly made from a paper board cut into a predetermined pattern with a plurality of folding lines embossed in advance which define several sections of the container. The paper board can be folded about the pre-embossed folding lines such that wall sections and corner sections are formed. Then, the corner sections so formed are overlapped and attached to the wall sections to form a container having one single compartment. To contain different kinds of solid or liquid foods without mixing their different tastes and flavors, several partitioning paper cards are disposed inside the container, giving it several compartments. Such paper cards are not convenient in use and are simple in structure, being movably attached or fixedly adhered to the bottom of the container without reinforcement provided at the periphery of the container. Therefore, such partitioning walls provide very weak supporting strength and are apt to break, and will no doubt cause troubles to the user. Moreover, liquid foods contained in the container easily mix with one another and lose their original tastes. Although the paper container is subject to natural decomposition and the environment pollution caused thereby is relatively low, the conventional paper container is not so practical in use and would need improvement.

It is therefore a need to develop a paper container which has secure multiple compartments and strengthened edges and can be easily manufactured to eliminate the above shortcomings existing in the conventional paper container.

SUMMARY OF THE INVENTION

It is a primary object of the present invention to provide a paper container with multiple compartments partitioned by walls in different heights. The paper container is formed from a paper board meeting the FDA regulations by cutting the same into a predetermined pattern which is formed with a middle opening and embossed with a plurality of separate folding lines to define multiple bottom sections, partitioning wall sections, front wall sections, rear wall sections, lateral wall sections, and top edge strip sections, wherein the bottom sections are located around the middle opening and each two adjacent partitioning wall sections adjoin each other at a folding line and have a width different from those of other pairs of adjacent partitioning wall sections. The front, rear and lateral wall sections are free from connection with any other wall sections and are connected with top edge strip sections. Three folding lines are formed at each corner contained by the adjacent wall sections, making the corner form two adjacent equiangular triangle-shaped corner connection sections, whereby each two adjacent corner connection sections and the adjacent top edge strip sections can be folded, overlapped and heat-sealed onto the adjacent front, rear and lateral wall sections through molds to form the paper container with multiple compartments partitioned by walls in different heights for more suitably and conveniently containing different kinds of foods.

It is a further object of the present invention to provide the above paper container, wherein the top edge strip sections are in strip form and adjoin the spaced front and lateral wall sections of the bottom sections. Each top edge strip section section has a projected end portion extending toward the adjacent bottom section and an opposed flat end whereby the top edge strip sections can be folded outward and heat-sealed to the adjacent front and lateral wall sections to form even and reinforced edges of the paper container and thus prevent the edges thereof from breaking in use.

The structure, features, functions, and other objects of the present invention, and the technical means adopted to achieve the present invention can be best understood through the following detailed description of the preferred embodiment and the accompanying drawings wherein:

DETAILED DESCRIPTION OF THE PREFERRED EMBODIMENTS

Figure 1:
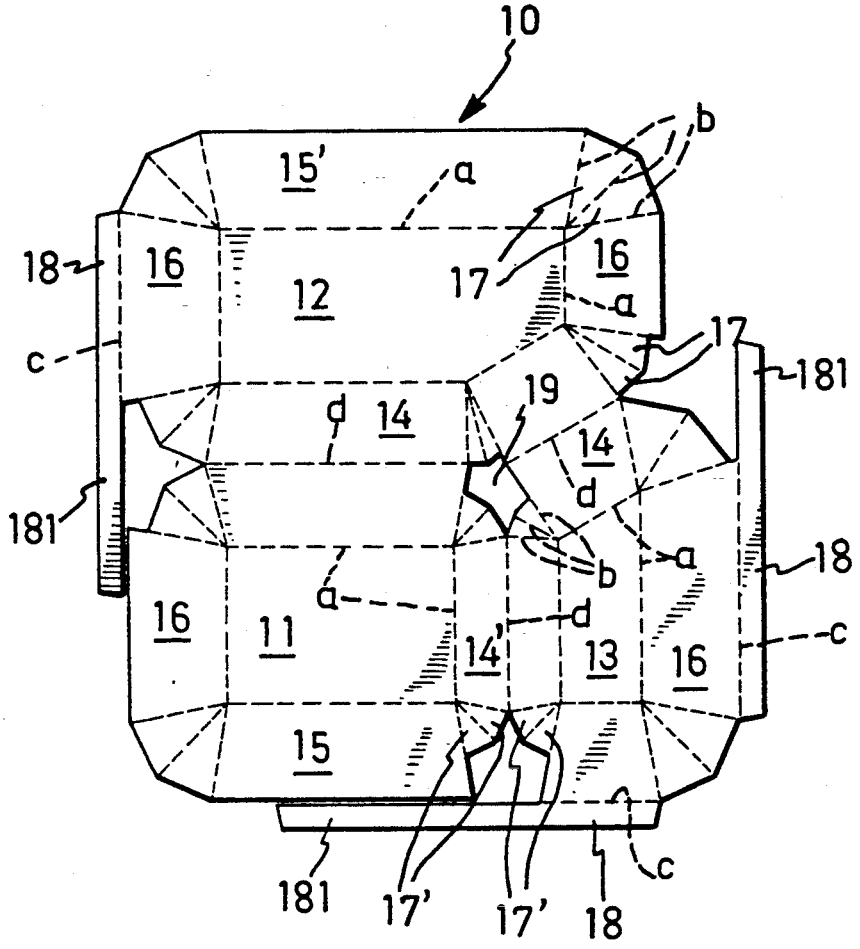
FIG. 1 is an unfolded paper pattern of the paper container according to the present invention.

The present invention is a paper container 10 which is formed from a paper board made of paper of pure fibers and additives being laminated to adequate thickness and coated with polyethylene to meet the FDA regulations. The paper board is cut to a paper pattern of predetermined configuration. The paper pattern of FIG. 1 is also formed with a middle opening 19 and a plurality of embossed folding lines a, b, c, and d, defining three bottom sections 11, 12 and 13, several partitioning wall sections 14 and 14', and front, rear and lateral sidewall sections 15, 15' and 16. The partitioning wall sections 14, 14' have different widths, whereby the paper pattern can be folded and heat-sealed to form the paper container 10 having three compartments separated by the partitioning walls in different heights for more suitably containing various foods or articles with different shapes and volumes.

Figure 2:
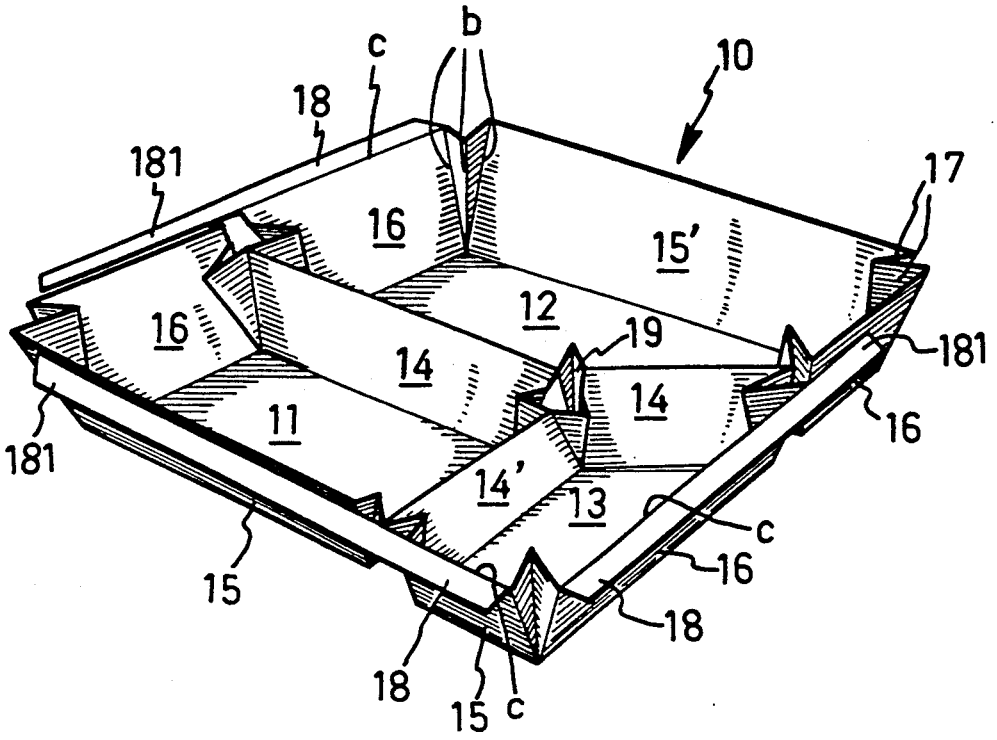
FIG. 2 shows the manner in which the paper container according to FIG. 1 is folded.

Please now refer to FIG. 1 which shows an unfolded paper pattern for forming the paper container 10 of the present invention, wherein the folding lines a to d divide the paper pattern into three bottom sections 11, 12 and 13. The partitioning wall sections 14, 14' and the front, rear and lateral sidewall sections 15, 15' and 16 adjoin the bottom sections 11, 12 and 13 at the folding lines a. Each two adjacent partitioning wall sections 14, 14' adjoin each other at the folding line d, whereby the adjacent partitioning wall sections 14, 14' can be folded about the folding line d to separate the bottom sections 11, 12 and 13 (as shown in FIG. 2). The front, rear and lateral sidewall sections 15, 15' and 16 are free from connection with other wall sections of the paper pattern. Three folding lines b are formed at each corner contained by the front, rear and lateral sidewall sections 15, 15' and 16 and the partitioning wall sections 14, 14', making the corner form two adjacent equiangular triangle-shaped corner connection sections 17, 17', whereby each two adjacent corner connection sections 17, 17' can be folded and overlapped to form the three compartments 11, 12 and 13 for conveniently containing different foods.

The front and lateral sidewall sections 15, 16 further adjoin top edge strip sections 18 at the folding lines c. Each top edge strip section 18 has a projected end portion 181 extending toward the adjacent bottom section and an opposed flat end, whereby, as shown in FIGS. 2 and 3, the top edge strip sections 18 can be folded outward about the folding lines c so as to be respectively evenly attached to and heat-sealed on the adjacent front and lateral sidewall sections 15 and 16 of the bottom sections 11, 12 and 13 with the projected end portions 181 flush with and attached to the front and lateral sidewall sections 15 and 16 of the adjacent bottom section 11 and 12 to form the paper container 10 with secure edges.

Figure 3:
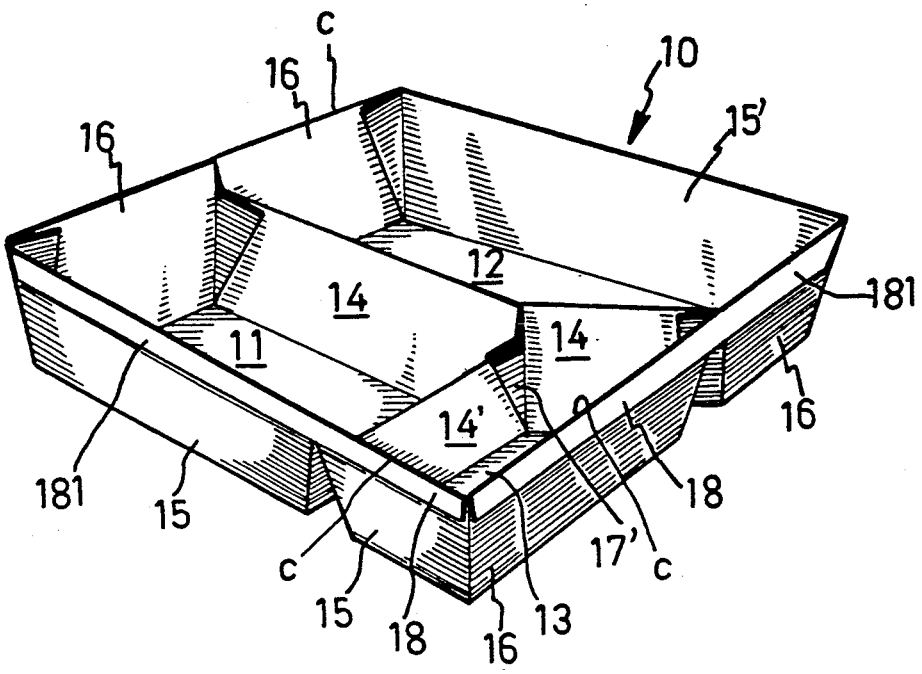
FIG. 3 shows the paper container folded, heat-sealed and finally formed from the paper pattern of FIG. 1.

Further referring to FIGS. 2 and 3, the partitioning wall sections 14' of two bottom sections 11 and 13 can be alternatively designed to have less width and the adjacent corner connection sections 17' can be correspondingly designed with less height so that when the paper pattern is folded and heat-sealed to form the paper container, the same will have a partitioning wall 14' with less height, making the upper portions of the adjacent compartments 11 and 13 communicate with each other, so that foods with relatively small volume, such as dried bean curd, fried chicken, snack, etc., or foods with relatively long size, such as chicken leg, barbecue brochette, fish, etc., can be conveniently placed in the compartments 11, 13. Therefore, different kinds of foods with different shapes and sizes can be contained in the compartments together without wasting the room thereof.

According to the above arrangements, the present invention can provide paper container having multiple compartments partitioned by walls of which the height can be freely designed for more suitably containing different kinds foods with different shapes or volumes.

It is to be understood that the above description and drawings are only used for illustrating one embodiment of the present invention, and is not intended to limit the scope of the present invention. Any variation and derivation from the above description and drawings should be included in the scope of the present invention.

What is claimed is:

1. A paper board made from a polyethylene coated laminate of fibers and additives, the paper board being foldable into a container having multiple compartments partitioned by walls of different heights and having a pattern comprising:

a) a middle opening formed in the pattern;

b) a plurality of embossed first folding lines defining a plurality of bottom sections positioned around the middle opening;

c) a plurality of sidewall sections, each sidewall section adjoining a bottom section along a first folding line;

d) a plurality of pairs of partitioning wall sections, each pair of partitioning wall sections being adjoined to each other along an embossed second folding line and each partitioning wall section being adjoined to a bottom section along a first folding line;

e) a plurality of corner sections, each corner section adjoining two adjacent sidewall sections, two adjacent partitioning wall sections or one sidewall section and one partitioning wall section, and each corner section being formed by a plurality of embossed third folding lines defining two adjacent equiangular triangular-shaped connection sections; and f) a strip section adjoining a top edge of each of at least some of the sidewall sections along an embossed fourth folding line, with each strip section being free from connection with any of the remaining sidewall sections.

2. The paper board of claim 1 wherein:

a) the sidewall sections include a pair of front sidewall sections, two pairs of opposed lateral sidewall section and a rear sidewall section;

b) the strip sections adjoin the top edges of one front sidewall section and each of two opposed lateral sidewall sections; and c) the strip section adjoining the front sidewall section extends towards the other front sidewall section and the strip sections adjoining the two opposed lateral sidewall sections each extend toward another lateral sidewall section.

* * * * *